US008302942B2

(12) United States Patent
Tsai

(10) Patent No.: US 8,302,942 B2
(45) Date of Patent: Nov. 6, 2012

(54) MICROBUBBLE WATER GENERATOR

(76) Inventor: Yih-Jin Tsai, Yongkang (TW)

( * ) Notice: Subject to any disclaimer, the term of this patent is extended or adjusted under 35 U.S.C. 154(b) by 498 days.

(21) Appl. No.: 12/647,790

(22) Filed: Dec. 28, 2009

(65) Prior Publication Data

US 2011/0156287 A1 Jun. 30, 2011

(51) Int. Cl.
*B01F 3/04* (2006.01)

(52) U.S. Cl. ..... 261/77; 261/118; 261/DIG. 54; 261/DIG. 75

(58) Field of Classification Search ..... 261/76, 261/77, 118, DIG. 54, DIG. 75
See application file for complete search history.

(56) References Cited

U.S. PATENT DOCUMENTS 6,193,893 B1 * 2/2001 Mazzei et al. ..... 210/702
* cited by examiner

*Primary Examiner* — Robert A Hopkins
(74) *Attorney, Agent, or Firm* — Muncy, Geissler, Olds & Lowe, PLLC

(57) ABSTRACT

A microbubble water generator includes a gas absorbing device respectively communicating with a pressure conveying motor, a gas supplier and a water switch. Wherein, the water switch is electrically connected with the pressure conveying motor and the gas supplier, and the pressure conveying motor communicates with a booster pipe. The booster pipe is further connected to a pressure release coupling, and the pressure release coupling thence joints to a water output valve, thereby outputting microbubble water with even and fine properties.

4 Claims, 4 Drawing Sheets

MICROBUBBLE WATER GENERATOR

BACKGROUND OF THE INVENTION

1. Field of the Invention

The present invention relates to a microbubble water generator, in particular to one applying a booster pipe to promote an admixture of gas and liquid for giving a rinsing object.

2. Description of the Related Art

A conventional bubble water generator commonly serves to directly introduce gas into water and allows the admixture of gas and water therefrom, which is so called the microbubble water. A typical technique especially includes a motor assembly mounted inside the generator and utilizes the rotation of a motor fan attempting to stir gas into water and so to attain bubble particles smaller than ones created by directly mixing gas and water. Whereas, the problem is that the bubble particles are not in a constant shape, so the typical invention still fails to efficiently diffuse the gas throughout the water in an even and tenuous manner and substantially confines effects on the application to water quality improvement, decomposition of pesticide remained on vegetables and fruits, cleaning of industrial instruments and family appliances, decomposition of organic contamination in water, and destruction of microorganism.

The above typical inventions can merely create the irregular bubble particles and maintain a short-period bubble life. Whereas, concerning a preferable microbubble water generator, it should obtain the condition of efficiently create fine and even bubble to coincide with the market's demand.

As in a prior invention, ⌈NANO OZONIC MICROBUBBLE WATER GENERATOR AND THE METHOD OF THE SAME⌋ published by R.O.C. Patent No. I298644, mainly directed to a generator applies a water pipe connected with a pressure conveying motor to render the pressurized water traveling a gas absorbing device through pipes and thence cause a negative pressure. The water would absorb ozone mixture created by an ozone generator for an initial admixture. The admixture of gas and water thence enters a closed counterpressure container for processing a step of dissolution, which hence completely dissolves ozone mixture in the water to become aqueous solution with high consistency of gas. The aqueous solution is guided from the pipes toward a pressure release valve, and so it could become multiple tiny nano bubbles as a result of relieving the solution of the pressure to quickly free the dissolved gas in the water. Accordingly, those nano bubbles are used to effect the promotion of decomposition of pesticide remained on vegetables and fruits, cleanser of kitchen appliances, decomposition of organic contamination in water, and destruction of microorganism. However, such invention suffered for a critical problem of the counterflow of water. Due to the fact that the generator mainly use a pressure switch to control the operating state of the pressure conveying motor, when turning off the water output, the water pressure inside the pipes would inevitably raise to bring the water back to the ozone generator and even damage it. Further, the concern of over-low flow speed of water would be unable to create the negative pressure and also result in an uneven gas volume within the water, thus still require improvements.

SUMMARY OF THE INVENTION

Therefore, the object of the present invention is to solve the aforementioned problems and to provide a microbubble water generator, which includes a gas absorbing device comprising a liquid entrance, a gas entrance, and an admixture exit; a pressure conveying motor comprising a first pipe connected with the admixture exit of the gas absorbing device and a second pipe disposed thereon; a gas supplier comprising a third pipe connected with the gas entrance of the gas absorbing device; a water switch disposed on a fourth pipe, wherein, the fourth pipe is jointed to the liquid entrance of the gas absorbing device, and the water switch has a detecting unit disposed thereon as well as inserted into an interior of the fourth pipe, and the water switch is electrically connected with the pressure conveying motor and the gas supplier; a booster pipe communicating with the pressure conveying motor and having an input end and an output end, wherein, the input end is connected with the second pipe of the pressure conveying motor; a pressure release coupling communicating with the output end of the booster pipe, wherein, the pressure release coupling has a partition therein, the partition includes at least one pore defined thereon, and further, the pressure release coupling is connected with a fifth pipe; and a water output valve communicating with the fifth pipe of the pressure release coupling.

Preferably, the liquid entrance of the gas absorbing device is formed of a gradually narrower contour.

Preferably, an anti-reflux valve is disposed in the gas entrance.

Preferably, a gas diffusing pipe extends outward from the second pipe and includes a plurality of apertures defined thereon.

Accordingly, the present invention has following advantages:

1. The present invention substantially attains microbubble water with even and tenuously fine properties for a preferable utilization.
2. The present invention is allowed to incessantly produce high consistency of microbubble water in the water. Accompanying the cooperation with air, oxygen, or ozone, the present invention preferably serves to adapt to the application of water quality improvement, decomposition of pesticide remained on vegetables and fruits, cleaning of industrial, medical and kitchen instruments as well as appliances, body cleanness, decomposition of organic contamination in water, and destruction of microorganism.
3. By virtue of the tiny bubbles created by the present invention lagging in the water to prolong the stay of bubbles in the water, a preferable reaction between bubble gas and remnant chemical components, microorganism, organic pollutants, an assortment of equipments, as well as human body could be attained.
4. The admixture of gas and water produced by the present invention is of quasi-white color analogous with milk, which permits the microbubbles to fully contact with various objects in irregular shapes and to invade into overall interstices for attaining a preferable reaction.
5. The present invention preferably adds a gas diffusing pipe connected to the input end of the booster pipe, on which apertures are disposed. Accordingly, the liquid could smoothly pass through the apertures for shaping into fine bubbles and thence enter the booster pipe for acting as dissolution and diffusion.
6. The pores on the partition of the pressure release coupling allow the gas and liquid to be remixed and rediffused, so as to promote the dissolution and diffusion of gas. The gas could be completely and maturely dissolved in the liquid and evenly dispersed among the liquid.
7. The liquid entrance of the gas absorbing device having a gradually narrow opening defined thereon facilitates to speed up the flowing of introduced liquid, and so a negative pressure could be achieved by smaller volume of water.

8. The present invention takes advantage of the pressure release coupling to control the water pressure and output volume of the booster pipe, and preferably, the output volume thereof could coincide with the output volume of the pressure conveying motor.
9. The present invention utilizes the water switch to synchronously control a pressurization of the pressure conveying motor and trigger the gas supplier to introduce gas. In time of outputting liquid, the pressure conveying motor and the gas supplier are simultaneously actuated for mixing the introduced liquid and gas. Hence, the present invention avoids the problem of unintentional inputting over stopping outputting water and prevents over-raising pressure caused by the above problem from damaging elements of the generator.
10. The present invention is assembled by fewer components and mechanical parts, which thence reduces costs and decreases failures.

DETAILED DESCRIPTION OF THE PREFERRED EMBODIMENTS

Figure 1:
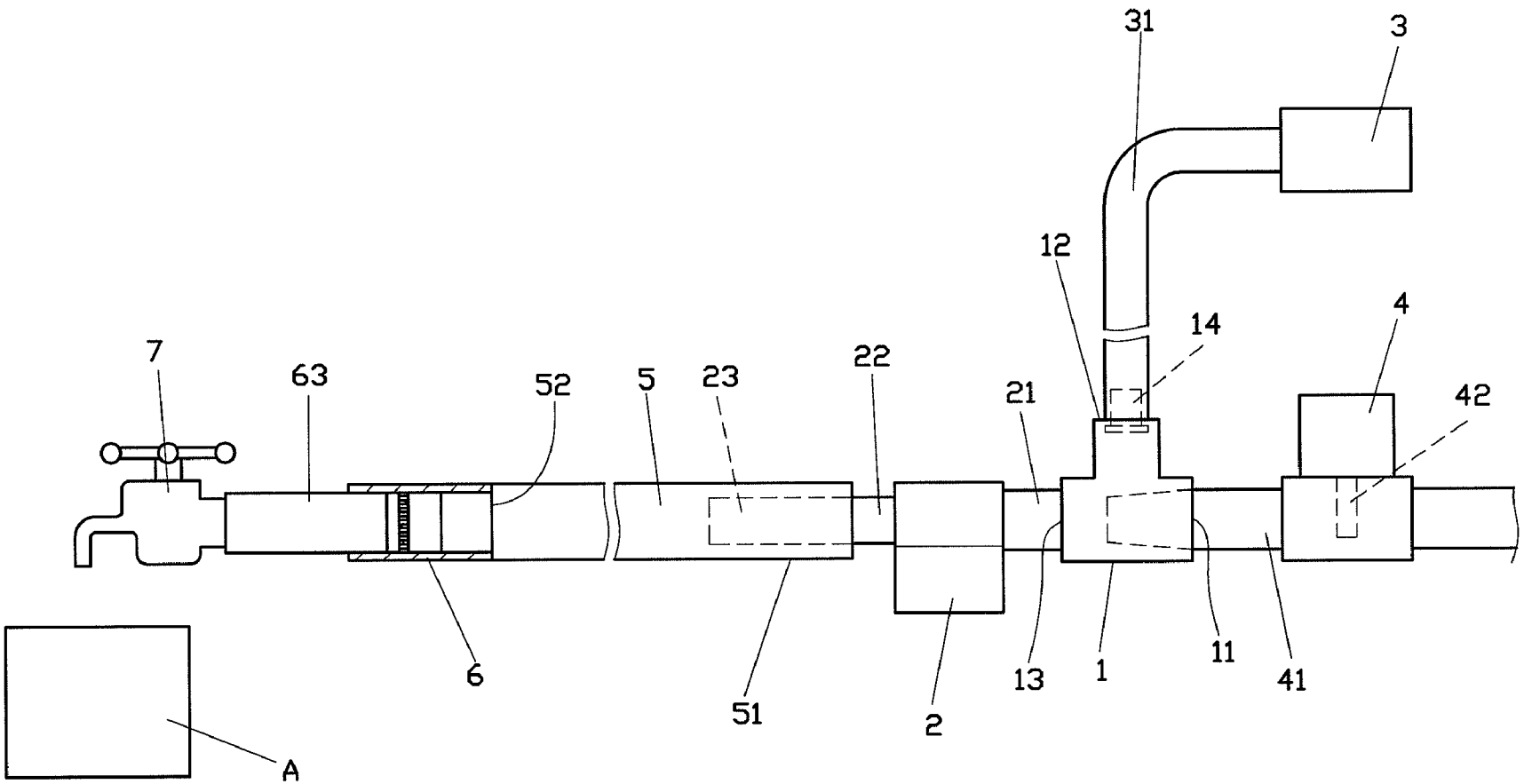
FIG. 1 is a schematic view showing the present invention.

Referring to FIG. 1, a microbubble water generator in conformity with the present invention includes a gas absorbing device 1, a pressure conveying motor 2, a gas supplier 3, a water switch 4, a booster pipe 5, a pressure release coupling 6, and a water output valve 7.

The gas absorbing device 1 comprises a liquid entrance 11, a gas entrance 12, and an admixture exit 13 which are communicated with each other. The liquid entrance 11 has an interior opening formed of a gradually narrower contour, so as to speedup the flowing of introduced liquid and thence create a negative pressure. Furthermore, the gas entrance 12 has an anti-reflux valve 14 disposed therein for entrance of gas without counterflow.

Figure 2:
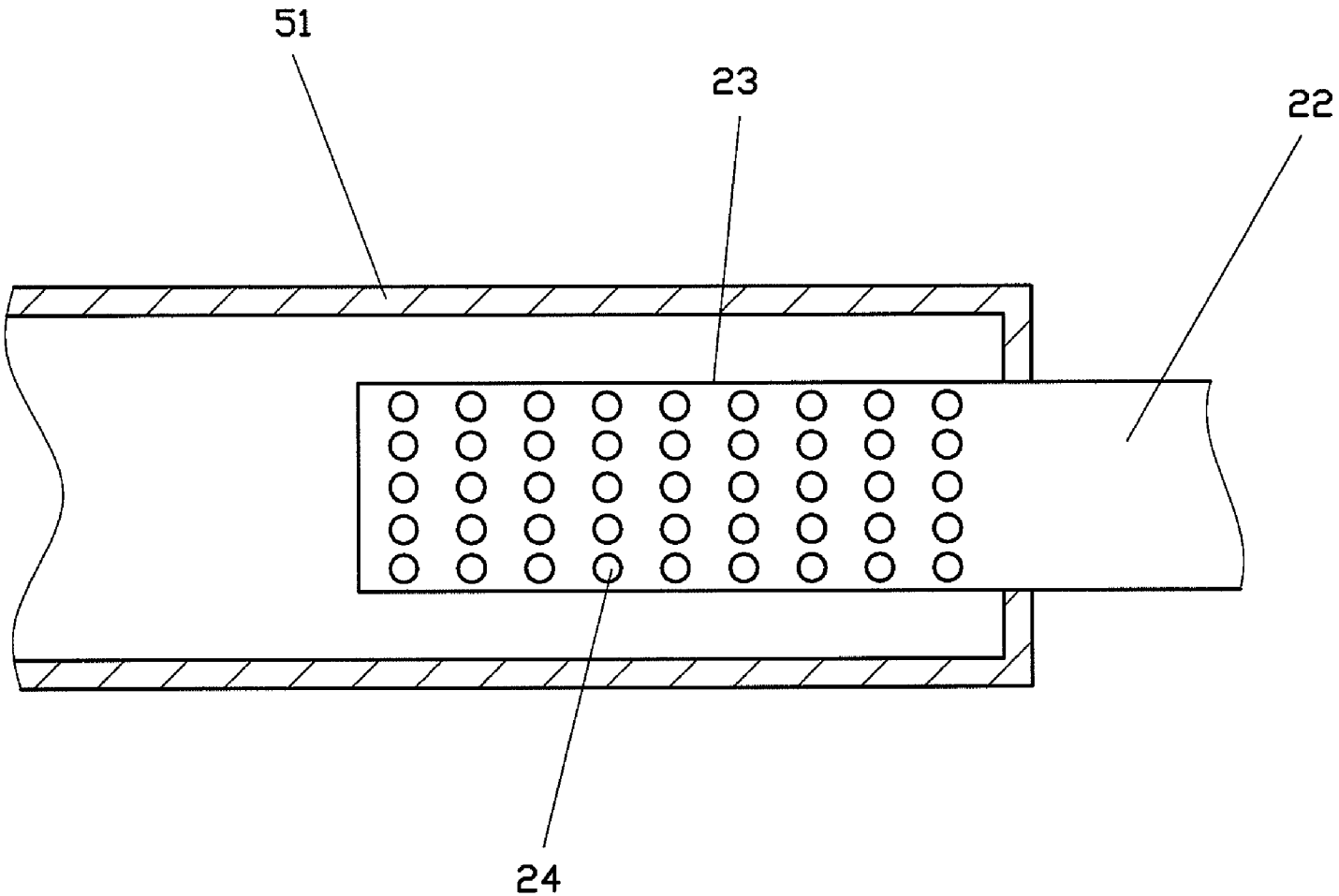
FIG. 2 is an enlarged view showing a partial combination of the gas diffusing pipe of the present invention.

The pressure conveying motor 2 communicates with the gas absorbing device 1. The pressure conveying motor 2 comprises a first pipe 21 and a second pipe 22. The first pipe 21 is connected with the admixture exit 13 of the gas absorbing device 1. Preferably, a gas diffusing pipe 23 extends outward from one end of the second pipe 22 and includes a plurality of apertures 24 defined thereon as shown in FIG. 2, so that after a pressurization upon the liquid introduced by the first pipe 21, the pressurized liquid could then pass through the apertures 24 of the gas diffusing pipe 23 of the second pipe 22 to become liquid with bubbles.

The gas supplier 3 communicates with the gas absorbing device 1. The gas supplier 3 comprises a third pipe 31 connected with the gas entrance 12 of the gas absorbing device 1. The gas supplier 3 could be an aerating instrument, an oxygen maker, an ozone maker, or other proper devices for supplying air, oxygen, or ozone into the subject generator.

The water switch 4 communicates with the gas absorbing device 1. The water switch 4 is disposed on a fourth pipe 41. The fourth pipe 41 is jointed to the liquid entrance 11 of the gas absorbing device 1. The water switch 4 has a detecting unit 42 disposed thereon. The detecting unit 42 inserts into an interior of the fourth pipe 41 for detecting the flowing state of the liquid inside the fourth pipe 41. Additionally, the water switch 4 is electrically connected with the pressure conveying motor 2 and the gas supplier 3. When the detecting unit 42 of the water switch 4 is subjected to a flush of the liquid inside the fourth pipe 41, the water switch 4 is thence triggered for commanding the pressure conveying motor 2 to start pressurizing and for controlling the gas supplier 3 to convey gas.

The booster pipe 5 communicates with the pressure conveying motor 2. The booster pipe 5 has an input end 51 and an output end 52. The input end 51 is connected with the gas diffusing pipe 23 of the second pipe 22 of the pressure conveying motor 2, so as to receive the liquid already blended with gas from the pressure conveying motor 2.

Figure 3:
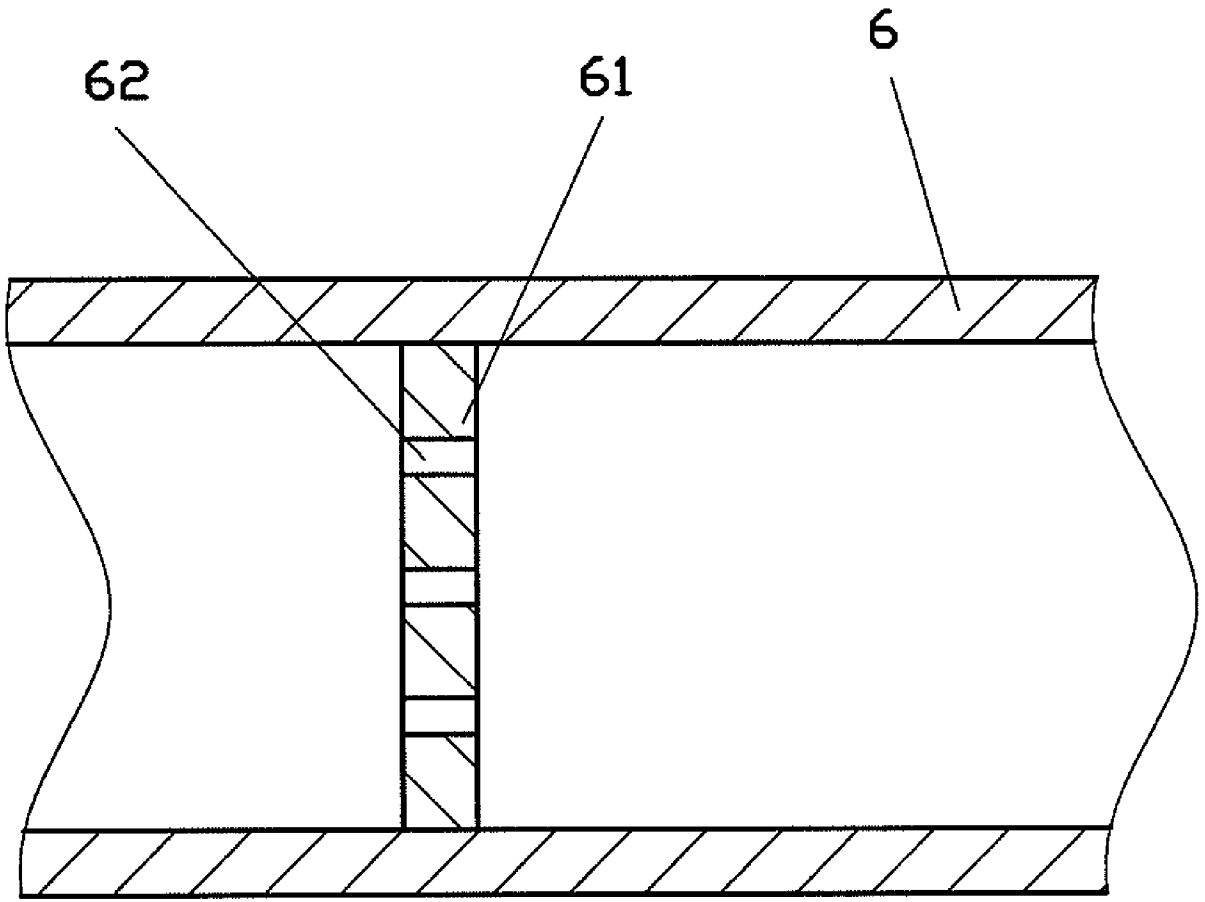
FIG. 3 is an enlarged view showing a partial combination of the partition in the pressure release coupling of the present invention.
Figure 4:
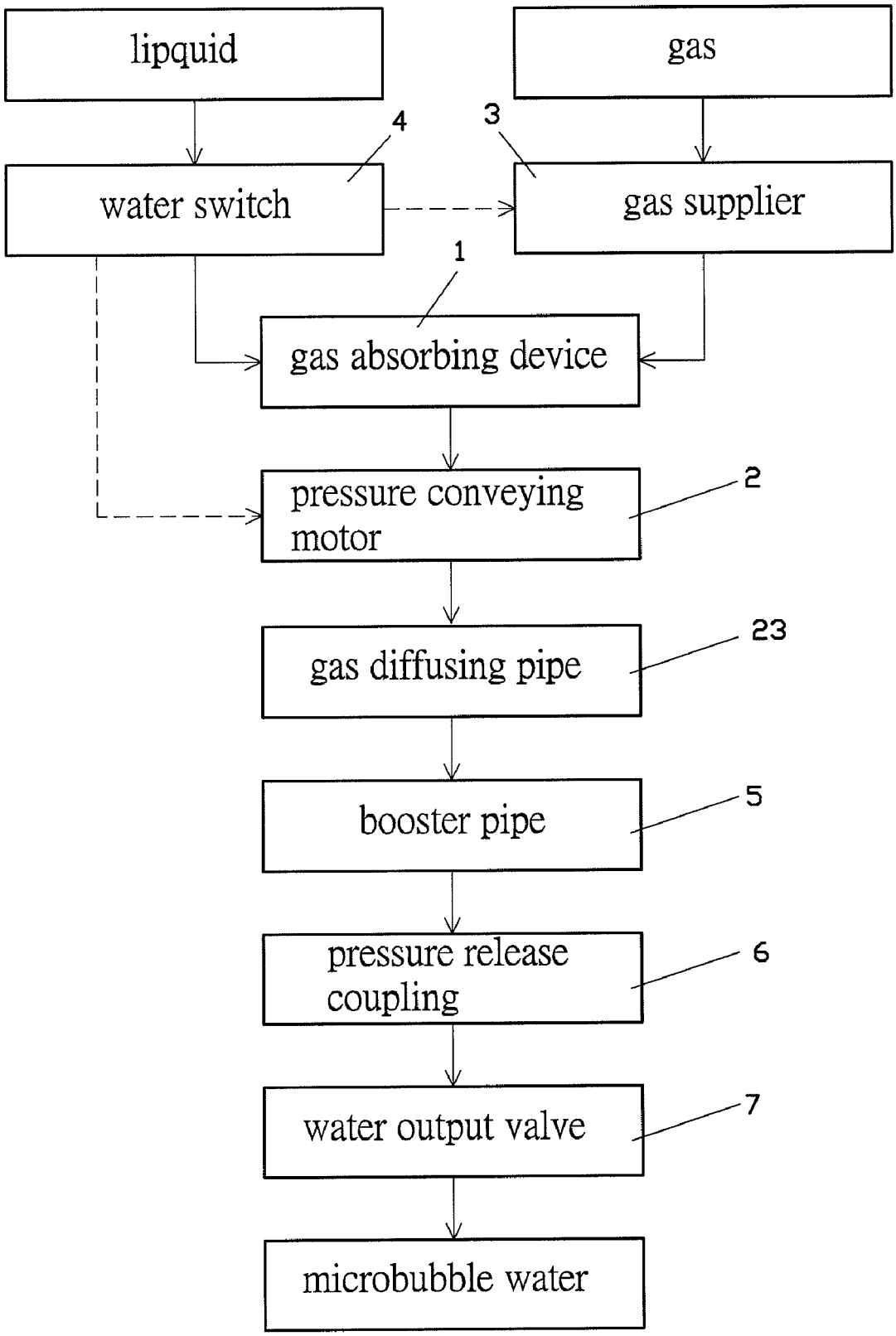
FIG. 4 is a schematic view showing the operation of the present invention.

The pressure release coupling 6 communicates with the output end 52 of the booster pipe 5. The pressure release coupling 6, as illustrated in FIG. 3, has a partition 61 therein. The partition 61 includes at least one pore 62 defined thereon, thereby serving to output microbubble water. In addition, the pressure release coupling 6 is further connected with a fifth pipe 63.

The water output valve 7 communicates with the fifth pipe 63 of the pressure release coupling 6 for controlling the output of liquid with microbubbles.

Referring to FIGS. 1 to 4, in operation, when turning on the water output valve 7 to output liquid, the liquid would be initially introduced from the fourth pipe 41 as a result of pressure difference. At the same time, the detecting unit 42 of the water switch 4 would suffer for the flush of the liquid inside the fourth pipe 41, and thence the water switch 4 would be triggered for commanding the pressure conveying motor 2 to start pressurizing and controlling the gas supplier 3 to convey gas. In view of the liquid entrance 11 providing an interior opening formed of a gradually narrower contour, the flowing of the liquid could be speed up for thence creating a negative pressure. Besides, the gas supplier 3 feeds gas to the third pipe 31, then through the gas entrance 12 and the anti-reflux unit 14, and thence into the gas absorbing device 1, in which the gas and liquid would proceed an initial mixture. Thereafter, the admixture of gas and liquid passes through the admixture exit 13 and the first pipe 21 and enters the pressure conveying motor 2. While passing through the apertures 24 of the gas diffusing pipe 23 at one end of the second pipe 22, the liquid would become tenuous and tiny bubbles and thence go into the booster pipe 5 along the input end 51 for proceeding dissolution and diffusion. The booster pipe 5 substantially prolongs the flowing of the liquid and conveys it toward the pressure release coupling 6 via the output end 52, and so the liquid would pass through the pores 62 on the partition 61 of the pressure release coupling 6 for remixing and redispersing the gas and the liquid, which facilitates the dissolution and diffusion of the gas. Accordingly, the gas could be absolutely dissolved in the liquid and evenly spread throughout the liquid, hence forming liquid with high consistency of gas. Once such liquid passes from the pressure release coupling 6 into the water output valve 7 along the fifth pipe 63, multiple tiny nano bubbles could be generated while relieving the liquid of the pressure to quickly free the dissolved gas in the water. Thence, the microbubble water is produced. It should note that such microbubble water is milk-white color due to the component of nano bubbles, which could be held in a tank A for adapting to the application of water quality improvement, execution of hydrotherapy, decomposition of pesticide remained on vegetables and fruits, cleaning of industrial as well as kitchen appliances, decomposition of organic contamination in water, and destruction of microorganism.

What is claimed is:

1. A microbubble water generator, including:

a gas absorbing device comprising a liquid entrance, a gas entrance, and an admixture exit;

a pressure conveying motor comprising a first pipe connected with said admixture exit of said gas absorbing device and a second pipe disposed thereon;

a gas supplier comprising a third pipe connected with said gas entrance of said gas absorbing device;

a water switch disposed on a fourth pipe, said fourth pipe being jointed to said liquid entrance of said gas absorbing device, said water switch having a detecting unit disposed thereon, said detecting unit inserting into an interior of said fourth pipe, said water switch being electrically connected with said pressure conveying motor and said gas supplier;

a booster pipe communicating with said pressure conveying motor, said booster pipe having an input end and an output end, said input end being connected with said second pipe of said pressure conveying motor;

a pressure release coupling communicating with said output end of said booster pipe, said pressure release coupling having a partition therein, said partition including at least one pore defined thereon, said pressure release coupling being connected with a fifth pipe; and a water output valve communicating with said fifth pipe of said pressure release coupling.

2. The microbubble water generator as claimed in claim 1, wherein said liquid entrance of said gas absorbing device is formed of a gradually narrower contour.

3. The microbubble water generator as claimed in claim 1, wherein an anti-reflux valve is disposed in said gas entrance.

4. The microbubble water generator as claimed in claim 1, wherein a gas diffusing pipe extends outward from said second pipe and includes a plurality of apertures defined thereon.

* * * * *